US005553113A

United States Patent [19]

Weedon

[11] Patent Number: 5,553,113

[45] Date of Patent: Sep. 3, 1996

[54] AUXILIARY DATA ACQUISITION IN A MEDICAL IMAGING SYSTEM

[75] Inventor: Hans Weedon, Salem, Mass.

[73] Assignee: Analogic Corporation, Peabody, Mass.

[21] Appl. No.: 342,311

[22] Filed: Nov. 18, 1994

[51] Int. Cl.[6] ..... H05G 1/64

[52] U.S. Cl. ..... 378/98.5; 382/131

[58] Field of Search ..... 382/131; 73/1 R, 73/1 DV; 364/571.03; 378/98.5, 98.4, 91, 114, 115, 4

[56] References Cited

U.S. PATENT DOCUMENTS 5,012,498 4/1991 Cuzin et al. ..... 378/4

*Primary Examiner*—Don Wong
*Attorney, Agent, or Firm*—Lappin & Kusmer LLP

[57] ABSTRACT

In a medical imaging system having a data acquisition system (DAS) that provides both image data and non-image data to a main computer of the medical imaging system via a plurality of DAS channels, wherein the DAS channels convey mostly image data, a method and apparatus is provided for selectively sampling and multiplexing auxiliary (AUX) data, such as system monitoring and system diagnostic data, and providing the AUX data along with the image data to a bank of analog-to-digital converters. A plurality of programmable sampling and multiplexing modes are provided so as to ensure that each AUX data signal is sampled at a rate that is appropriate to a phase of operation of the medical imaging system, such as system monitoring, or system diagnostics.

20 Claims, 5 Drawing Sheets

OUTPUT LINE

| TIME SLOT | 2 | 4 | 6 | 1 | 3 | 5 |
|---|---|---|---|---|---|---|
| 0 | TH1 | TH8 | TH15 | VP1 | VP2 | VP3 |
| 1 | CJT1 | TH9 | TH16 | VP4 | VP5 | VP6 |
| 2 | TH2 | TH10 | TH17 | VP7 | VP8 | VP9 |
| 3 | TH3 | CJT2 | TH18 | VP10 | VP11 | VP12 |
| 4 | TH4 | TH11 | TH19 | VN1 | VN2 | VN3 |
| 5 | TH5 | TH12 | CJT3 | VN4 | VN5 | VN6 |
| 6 | TH6 | TH13 | TH20 | VN7 | VN8 | VN9 |
| 7 | TH7 | TH14 | GND | VN10 | VN11 | VN12 |

FIG. 6

| TIME SLOT | | | | | | |
|---|---|---|---|---|---|---|
| 0 | VN1 | VN2 | VN3 | VP1 | VP2 | VP3 |
| 1 | VN4 | VN5 | VN6 | VP4 | VP5 | VP6 |
| 2 | VN7 | VN8 | VN9 | VP7 | VP8 | VP9 |
| 3 | VN10 | VN11 | VN12 | VP10 | VP11 | VP12 |
| 4 | VP1 | VP2 | VP3 | VN1 | VN2 | VN3 |
| 5 | VP4 | VP5 | VP6 | VN4 | VN5 | VN6 |
| 6 | VP7 | VP8 | VP9 | VN7 | VN8 | VN9 |
| 7 | VP10 | VP11 | VP12 | VN10 | VN11 | VN12 |

FIG. 7

| TIME SLOT | | | | | | |
|---|---|---|---|---|---|---|
| 0 | VN1 | VN2 | VN3 | VP1 | VP2 | VP3 |
| 1 | VN1 | VN2 | VN3 | VP4 | VP5 | VP6 |
| 2 | VN1 | VN2 | VN3 | VP7 | VP8 | VP9 |
| 3 | VN1 | VN2 | VN3 | VP10 | VP11 | VP12 |
| 4 | VN1 | VN2 | VN3 | VN1 | VN2 | VN3 |
| 5 | VN1 | VN2 | VN3 | VN4 | VN5 | VN6 |
| 6 | VN1 | VN2 | VN3 | VN7 | VN8 | VN9 |
| 7 | VN1 | VN2 | VN3 | VN10 | VN11 | VN12 |

FIG. 8

AUXILIARY DATA ACQUISITION IN A MEDICAL IMAGING SYSTEM

FIELD OF THE INVENTION

This invention relates generally to data acquisition in a medical imaging system, and more particularly to acquisition of system monitoring and system diagnostic data in a CT scanner.

BACKGROUND OF THE INVENTION

In a medical imaging system, such as a low-cost CT scanner, low-cost components must be efficiently used to ensure that the medical imaging instrument will be affordable. However, the accuracy and stability of the low-cost components can be unacceptable. For example, commonly encountered environmental conditions can adversely affect the accuracy and stability of the various components of a CT scanner. To compensate for these effects, measurements must be made of various system operational parameters and conditions for system monitoring, and system diagnostic conditions for system testing and debugging. Further, the measurements must be made on a real-time basis.

For example, the measurements of system operational and system diagnostic parameters and conditions that can advantageously be made include:

- measurements of the temperature of various subsystems;
- measurements of the position of the x-ray tube focal spot;
- measurements of vibrational motion of the x-ray tube;
- measurements of the voltage of various electrical subsystems; and
- measurements of the electrical current of various electrical subsystems.

It is known to provide one or more separate measuring systems for performing each type of measurement, each measuring system being connected to a main computer of the medical imaging system via an information signal transmission channel having a separate A/D converter and separate cabling. This approach can be expensive, can add excessive weight and complexity to the medical imaging system, and can occupy large amounts of space.

To avoid separate dedicated cabling, it is known to deliver system monitoring and system diagnostic measurement information to the main computer via a data acquisition system (DAS), where the DAS conveys primarily image data to the main computer. In particular, the DAS accommodates a plurality of information signal transmission channels, each channel conveying data encoded as a stream of data words. However, the DAS can accommodate only a limited number of channels for conveying non-image data. Each type of non-image data typically requires at least one DAS channel, and there can be several times more types of measurements needed for proper characterization of the subsystems of the CT scanner than the number of available non-image DAS channels.

OBJECTS OF THE INVENTION

It is a general object of the present invention to acquire auxiliary data in a medical imaging system of the type described that significantly reduces or overcomes the problems of the prior art.

A more specific object of the present invention is to avoid the use of a separate monitoring or diagnostic measurement system for each such measurement to be performed.

Another object of the invention is to avoid the need for a separate A/D converter and separate cabling to connect each separate measurement system to a main computer.

And another object of the invention is to convey auxiliary data, such as system monitoring or system diagnostic measurement data, via a plurality of data acquisition system (DAS) channels that are primarily dedicated to conveying image data, without sacrificing throughput of the image data.

Still another object of the present invention is to provide a CT scanner capable of transmitting auxiliary data through the same DAS used to process image data.

Yet another object of the present invention is to provide a programmable auxiliary data acquisition system for use in a CT scanner.

And still another object of the present invention is to provide an auxiliary data acquisition system adapted to transmit a preselected sequence of auxiliary data as a function of the operating mode of the scanner.

And yet another object of the invention is to rapidly and conveniently change from a system operation monitoring mode to a diagnostic debugging mode.

Other objects of the present invention will in part be suggested and will in part appear hereinafter. The invention accordingly comprises the apparatus possessing the construction, combination of elements, and arrangement of parts, and the processes involving the several steps and the relation and order of one or more of such steps with respect to the others, all of which are exemplified in the following detailed disclosure and the scope of the application, all of which will be indicated in the claims.

SUMMARY OF THE INVENTION

The method and apparatus of the present invention is designed for use in a medical imaging system having a data acquisition system (DAS) that sends both image data and non-image data to a main computer of the medical imaging system via a plurality of DAS channels, wherein the DAS channels are primarily dedicated to conveying image data. The method and apparatus conveys auxiliary (AUX) data, such as system monitoring and system diagnostic data, along with the image data via the DAS channels. The AUX data can include measurement data that is used to compensate for inaccuracies and instabilities of various components of the medical imaging system.

The total data rate of the AUX data generated in the medical imaging system exceeds the throughput capacity of a set of the DAS channels dedicated to the AUX data. Consequently, in a monitoring mode, all of the types of AUX data relevant to the monitoring mode are each selectively sampled and multiplexed in a predetermined sequence so as to allow all of the relevant types of AUX data to be transmitted when needed over the DAS channels along with the image data, without reducing the throughput of the image data over the DAS channels. For types of AUX data that change slowly compared to the image data, selective sampling of the auxiliary data occurs often enough so as to provide sufficient system monitoring information. In a preferred embodiment, selective sampling occurs periodically.

However, when system diagnostics must be performed, for some types of AUX data, selective sampling does not occur often enough to provide sufficiently immediate or timely information. Consequently, in a diagnostic mode, some types of AUX data are provided at a higher rate, and some types of AUX data that are not relevant to system diagnostics, testing, or debugging are not sampled in the diagnostic mode, so as to ensure that the total data rate of the AUX data transmitted over the DAS channels in the diagnostic mode does not exceed the throughput capacity of the set of DAS channels dedicated to the AUX data.

Other intermediate modes that sample an intermediate number of data types, each at an intermediate rate, are also possible and useful.

Further efficiencies are achieved by using one or more A/D converters that operate on the image data to also operate on the auxiliary data.

BRIEF DESCRIPTION OF THE DRAWINGS

The invention will be more fully understood from the following detailed description, in conjunction with the accompanying figures, wherein:

FIG. 6 is a first matrix of AUX data signal labels organized according to time slot and output line;

FIG. 7 is a second matrix of AUX data signal labels organized according to time slot and output line; and FIG. 8 is a third matrix of AUX data signal labels organized according to time slot and output line.

DETAILED DESCRIPTION OF THE DRAWINGS

Figure 1:
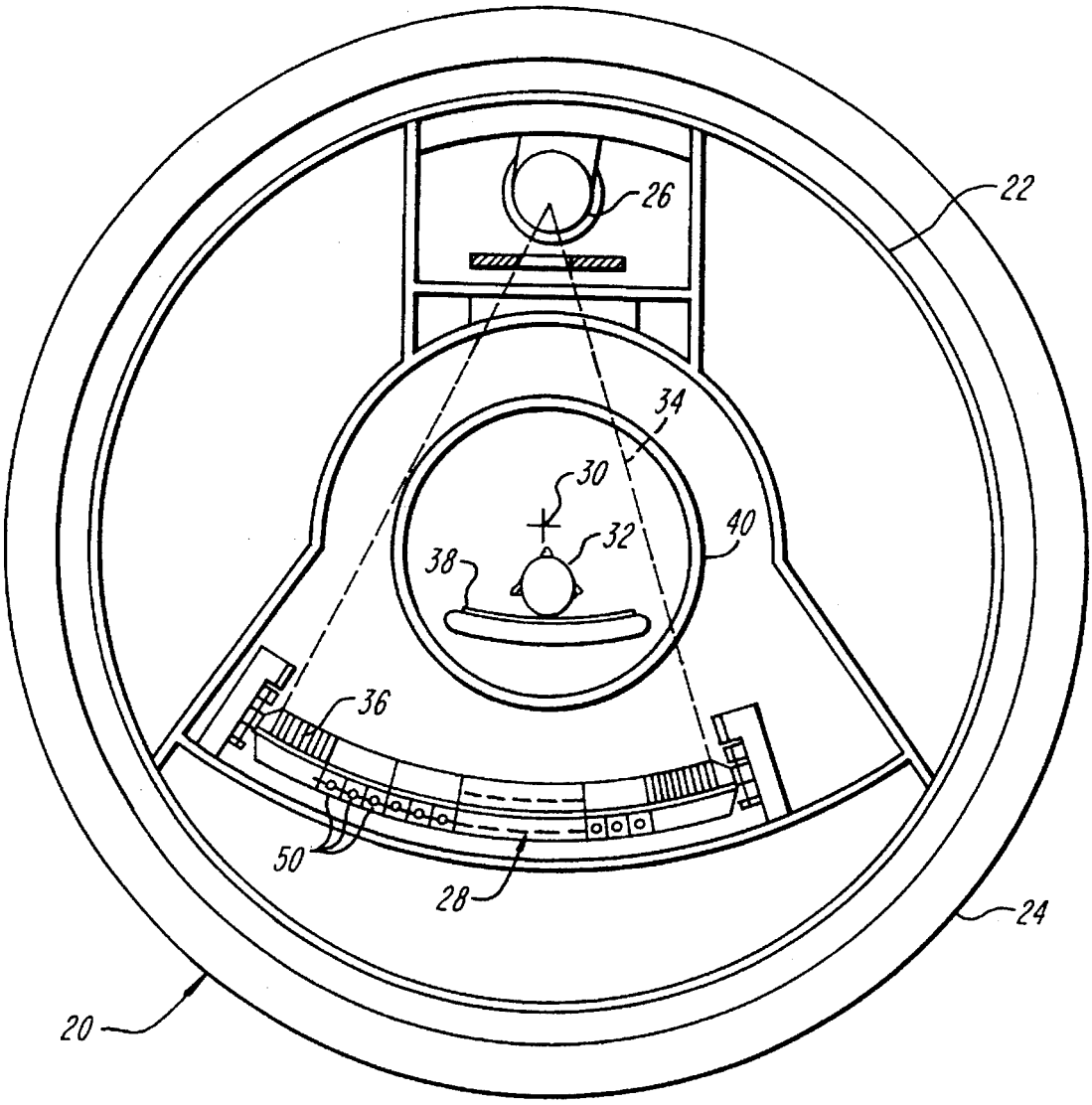
FIG. 1 is a end view of a CT scanner of the type that can incorporate the present invention.

FIG. 1 shows a CAT scanner 20 of the third generation type. The scanner comprises a disk 22 mounted for rotation in a stationary gantry support 24. The disk 22 supports an X-ray source 26 and an arcuate image data detector array assembly 28 comprising a plurality of detectors 50. Source 26 and detector assembly 28 are rotated about rotation axis 30 (extending normal to the view shown in FIG. 1) so as to rotate around the object 32 that extends through the central opening of the disk during the CAT scan. Object 32 may be a part of a live human patient, such as the head or torso. Source 28 emits radiation through a slit (not shown) so as to define within a scanning plane, a continuous fan-shaped beam 34 of X-rays, which is sensed by the detectors 50 of assembly 28 after passing through object 32. An array of anti-scatter plates 36 is located between object 32 and the detectors 50 of assembly 28 to substantially prevent scattered rays from being sensed by the detectors. In a CT scanner under development the detectors number 384 and cover an arc of 48°, although the number and angle can vary. Disk 22, which may advantageously be of a light weight material, such as aluminum, is caused to rotate rapidly and smoothly around axis 30. The disk 22 is of an open frame construction so that object 32 can be positioned through the opening of the disk. Object 32 may be supported, for example, on a pallet or table 38, which of course, should be as transparent as practical to x-rays. As disk 22 rotates, detectors 50 of assembly 28 are periodically sampled, in a predetermined sequence to provide discrete measurements of x-rays passing in the scanning plane through object 32 from many projection angles. The measurements are then processed electronically with appropriate signal processing equipment, in accordance with well-known mathematical techniques, so as to produce the final image information. The image information may then be placed in memory, analyzed in a computer, or suitably displayed. The final image will be one of the mass contained within the "field of view" of the scanner (as indicated by the circle 40 in FIG. 1) within the scanning plane. To the extent described, the system is the same as the one described in application, Ser. No. 08/190945, filed Feb. 3, 1994, now U.S. Pat. No. 5,487,098, in the names of John Dobbs and David Banks for a MODULAR DETECTOR ARRANGEMENT FOR X-RAY TOMOGRAPHIC SYSTEM and commonly assigned to the present assignee.

In a CT scanner under development, there are 384 x-ray detectors, and a corresponding number of image data DAS channels for reading out image data from the detectors. There are also 16 additional non-image data DAS channels for reading out non-image data, of which eight relate to monitoring of x-ray exposure levels at the detectors, and eight relate to auxiliary (AUX) data, such as system monitoring and system diagnostic data. Since one word is read out per channel, there are in total, 400 (16-bit) words that are read out of the scanner per projection view. The 400 words are read out sequemially at a rate of 1.5 microseconds per word. Therefore, reading the data for each projection view requires about 600 microseconds. The overall projection rate at which the scanner can read out an entire data structure is about 1440 projections per second. A complete scanned image consists of data acquired from 2880 projections.

There can be more AUX data detectors in a CT scanner (for acquiring subsystem characterization and measurement data during system monitoring and system diagnostics) than the number of DAS channels available for AUX data. Some of the data may be more important in one mode of testing than in another. Consequently, according to the invention, multiplexing is used to read out a greater variety of characterization and measurement data per view over the eight AUX data DAS channels than the fixed capacity of the eight AUX data channels would ordinarily allow and the actual sequence in which data is multiplexed can be changed as a function of the testing mode. For example, any one of several multiplexing arrangements for a 8×6 matrix of data (representing the outputs from 48 AUX data detectors) can be used. A 8:1 multiplexing, for example, can be applied on each of six AUX data channels, thereby allowing AUX data from as many as 48 different AUX data detectors to be conveyed by the six AUX data channels over each sequence of eight consecutive projection views of a scan. Thus, since data is multiplexed at a ratio of 8:1, multiplexing the AUX data allows data from eight times more channels to be processed using the six AUX data channels than without multiplexing. Of course, any number of AUX data channels other than six can also be used.

Figure 2:
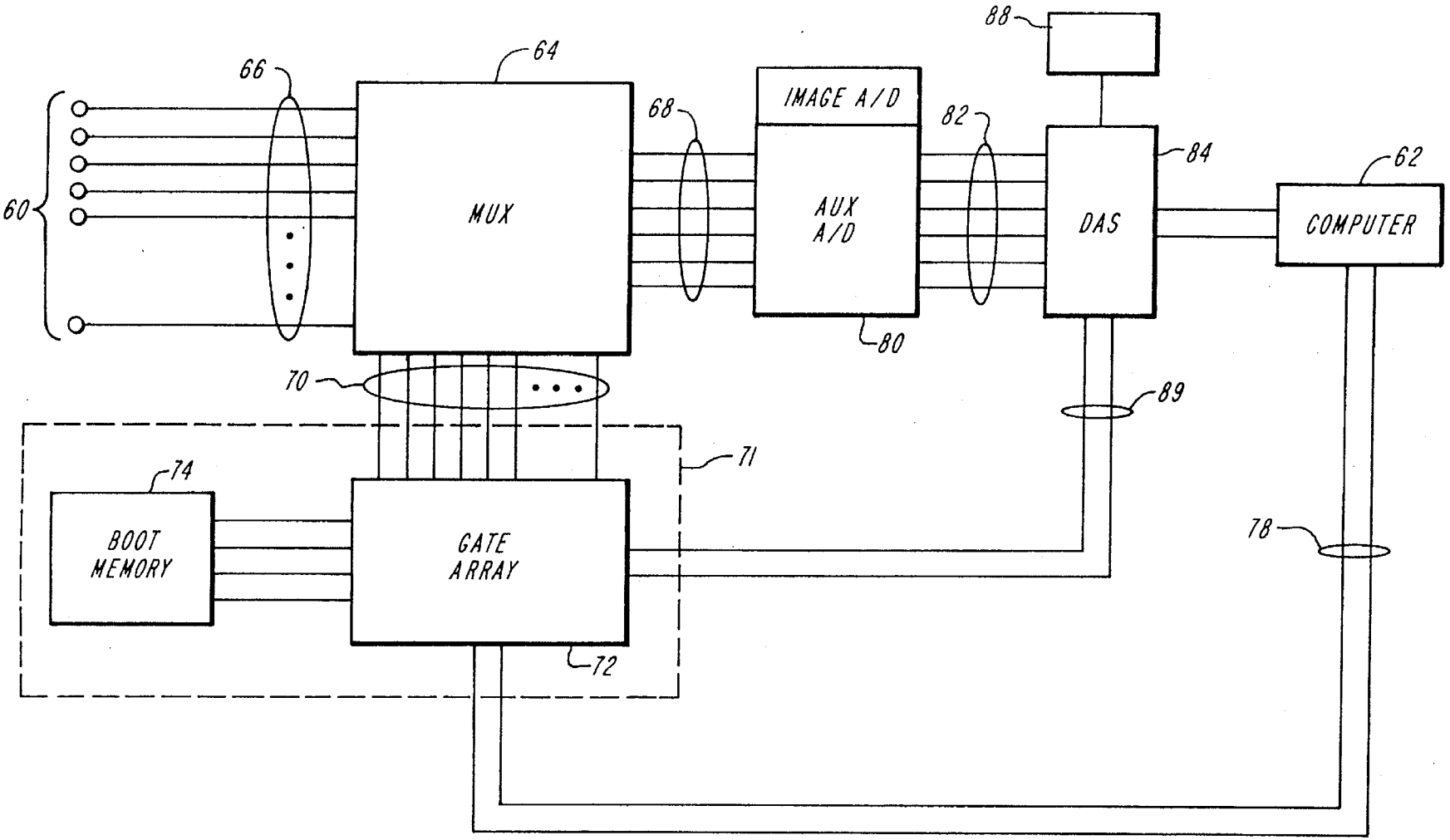
FIG. 2 is a block diagram of the data acquisition apparatus of the invention, including a multi-mode multiplexer.

FIG. 2 shows the flow of measurement data from forty-eight measurement sensors 60 to the main computer 62 of a CT scanner. The measurement sensors 60 can include a plurality of thermocouples placed at various locations in the CT scanner, such as near the x-ray tube; one or more cold junction compensators, such as provided in the chip set LT1025A, LT2012A, and LT 1055C, placed far from heat sources to be monitored, that provide a reference voltage to be compared with the voltage provided by each thermocouple so as to provide first order correction of the nonlinearity and offset of the thermocouple; and voltage/current input devices for measuring current, such as a current generated when a voltage to be measured is applied across a known resistance. The voltage/current input devices can be advantageously divided into positive voltage/current input devices and negative voltage/current input devices.

The forty-eight measurement sensors 60 provide forty-eight respective measurement signals over forty-eight input lines 66 to a 48:6 analog multiplexer (MUX) 64 having six output lines 68. The MUX 64 is controlled by, for example, thirty-three select (address) lines 70 that determine when the data from each of the forty-eight detectors 60 will appear on one of the six output lines 68. The select lines 70 originate from a control logic module 71 that includes a programmable state machine, such as XILINX programmable gate array 72 that is cooperative with a XILINX boot memory module 74, the latter for storing one or more programs for configuring the logic of the programmable gate array 72. Thus, the sequence of select or address signals provided to the MUX 64 can be changed merely by reconfiguring or reprogramming the logic of the programmable gate array 72. The logic of the programmable gate array 72 can be changed when an operator of the main CT scanner system computer 62 issues an appropriate command, in response to which command the computer 62 generates a control signal via one or more gate array control lines 78 that causes the gate array 72 to load a new logic configuration from the memory module 74.

The six output lines 68 from the MUX 64 provide respective analog signals to an array of analog-to-digital A/D converter channels 80, some of the A/D converter channels being dedicated to image data, the remaining A/D converter channels being dedicated to AUX data. The A/D converter channels 80 provide six digital signals 82 representative of the respective AUX data signals. Signals 82 are received by a data acquisition system (DAS) 84 that processes the digital signals 82 and provides the resulting data to the main computer 62 for further analysis and can provide control data over lines 89 to gate array 72. The DAS 84 receives a clock signal 86 from a DAS clock signal generator 88.

Figure 3:
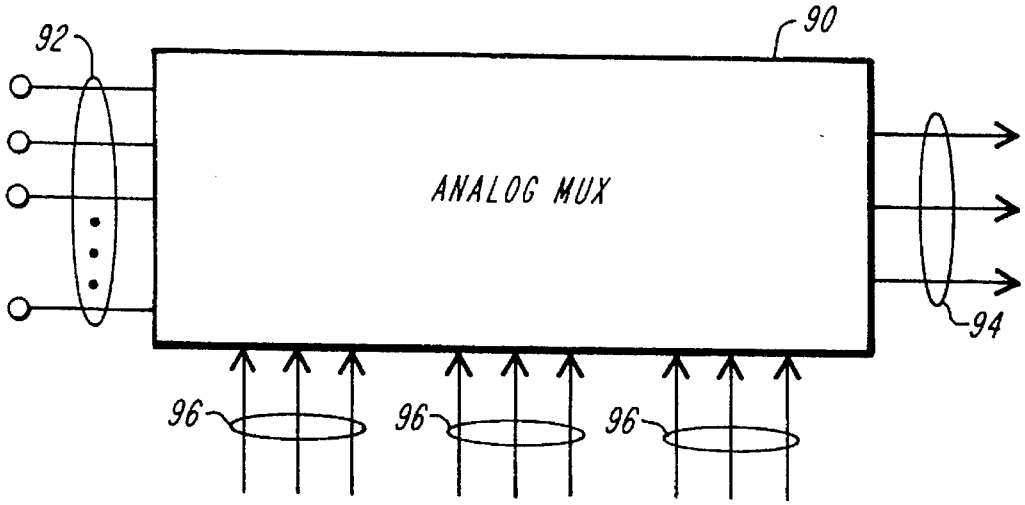
FIG. 3 is a block diagram of the input, output, and select lines of a first analog multiplexer of the multi-mode multiplexer of FIG. 2.

A preferred embodiment of the analog MUX 64 of FIG. 2 includes two 24:3 analog multiplexer modules 90, one being shown in FIG. 3, having twenty four input lines 92 and three output lines 94. The multiplexer module 90 performs 8:1 multiplexing for each of the three output lines 94 using, for example, three 8:1 MUX's, such as three CMOS 4051 MUX's. 8:1 multiplexing requires three select (address) lines for each group of eight input lines, and therefore nine select lines 96 are used to determine the sequence that the twenty-four analog signals on the twenty-four input lines 92 appear on the output lines 94.

The twenty-four analog signals on the input lines 92 can represent any set of measurements. For example, they can represent twenty temperature measurements provided by twenty temperature sensors, three cold junction temperature measurements for purposes of calibrating the twenty temperature measurements provided by the twenty temperature sensors, and a system ground voltage measurement for providing an offset voltage of the twenty temperature sensors. The cold junction temperature signal can advantageously be placed via multiplexing on each of the three output lines 94.

Figure 4:
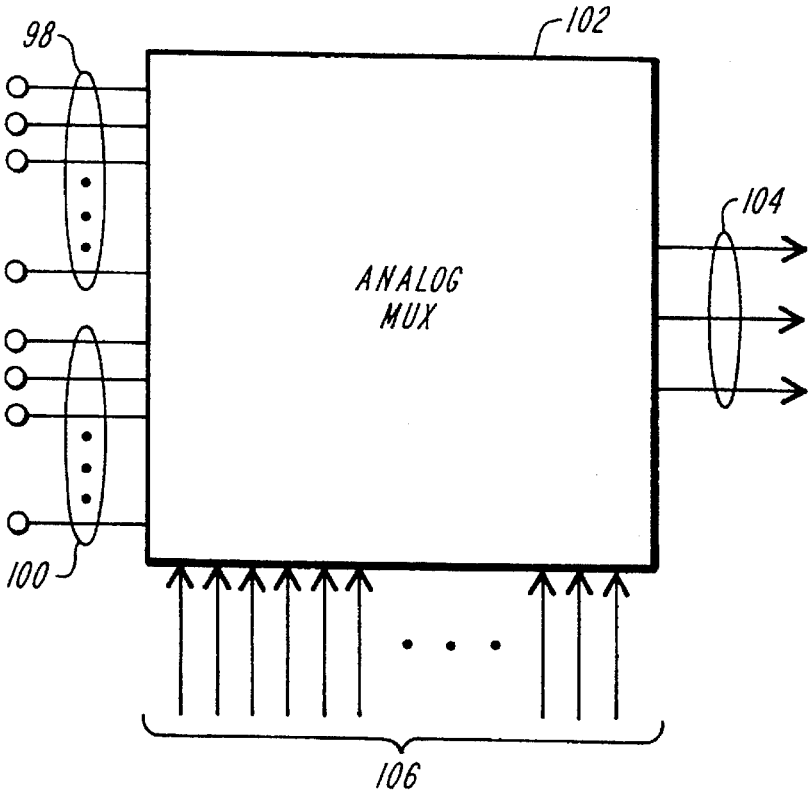
FIG. 4 is a block diagram of the input, output, and select lines of a second analog multiplexer of the multi-mode multiplexer of FIG. 2.

FIG. 4 shows another way to achieve 24:3 multiplexing. In this example, twelve positive current measurement signals on twelve input lines 98 and twelve negative current measurement signals on twelve input lines 100 are multiplexed by a multiplexer module 102 to provide three multiplexed analog output signals on three output lines 104. The multiplexer module 102 can be constructed of twenty-four, single-pole, double-throw (SPDT) analog switches, wherein each SPDT switch is controlled by a corresponding select (address) line 106 for providing a binary signal that determines the state of the SPDT switch. As is well-known in the art, by summing the outputs of eight of the SPDT switches, and suitably coordinating the enablement of the eight respective select lines 106, 8:1 multiplexing can be achieved. A CMOS device can be used to provide three SPDT analog switches, and therefore, eight 4053's provides twenty-four SPDT analog switches having twenty-four inputs, and can be connected so as to provide 8:1 multiplexing on each of the three output lines 104.

Of course, as is well-known in the art, there are many other ways to implement a 24:3 multiplexer, such as using six 4:1 multiplexers controlled by twelve select lines.

The actual sequence of selectively applying the twenty-four analog input signals on the three output lines 94, is determined by the nine select lines 96 (of FIG. 3), and by the twenty-four select lines 106 (of FIG. 4), which are controlled by the control module 71 (of FIG. 2).

Figure 5:
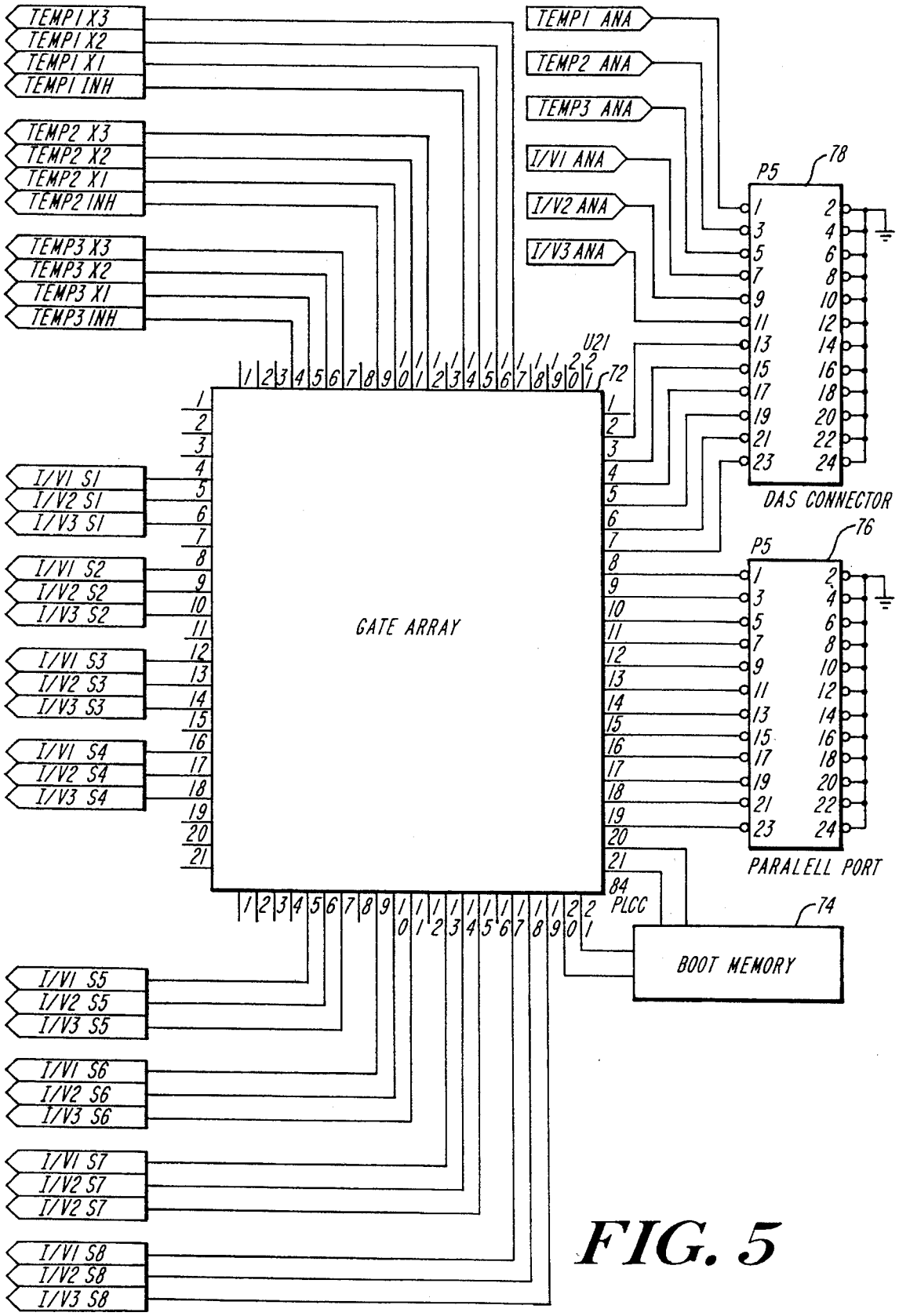
FIG. 5 is a block diagram showing a preferred embodiment of the control logic module and associated signal lines of FIG. 2.

The select lines 96 and 106 of FIGS. 3 and 4, respectively, provide digital control signals to the multiplexers 90 and 102 that determine when each of the input signals 92, 98, and 100 will appear on the output lines 94 and 104. The digital control signals can originate from any digital device, such as a computer, or a field programmable gate array, such as a XILINX Gate Array 72, controlled by a computer (shown at 62 in FIG. 2) via at least a parallel port 76, as shown in FIG. 5. The gate array 72 can be programmed at boot time by using a read-only-memory (ROM), such as a XILINX Boot Memory 74, wherein the memory 74 stores more than one program for configuring the logic of the gate array 72. Once the user-selected program is transferred to the gate array 72 at boot time, it can be selectively activated via control signals provided via the parallel port 76 from the computer 62 (of FIG. 2). Thus, since each program can represent a different control mode corresponding to a unique sequence of digital control signals for controlling the multiplexers 90 and 102, different sequences of input signals 92, 98, and 100 can be made to appear on the output lines 94 and 104, respectively, simply by executing a different program stored in the gate array 82 in response to control signals received via the parallel port from the computer 62. Control signals, or system status digital data for controlling the gate array 82 can also be sent to the gate array 82 via the DAS connector 78.

Referring to FIG. 6, for example, in a first control mode, each of the six output lines 94 and 104 of the multiplexers 90 and 102 can be made to sequentially provide one of eight different temperature measurement signals TH# within one of eight repeating time slots, rows 0–7, wherein a different temperature measurement signal is placed on a particular output line, columns 1–6, upon the occurrence of each of the eight repeating time slots. To illustrate this, FIG. 6 shows an 8×6 matrix having a different measurement signal for each of eight time slots, and for each of six output lines.

In particular, in the first of eight time slots, a temperature measurement signal TH1 is placed on output line number 2, a temperature measurement signal TH8 is placed on output line number 4, a temperature measurement signal TH15 is placed on 1 output line number 6, a positive voltage/current measurement signal VP1 is placed on output line number 1, a positive voltage/current measurement signal VP2 is placed on output line number 3, and a positive voltage/current measurement signal VP3 is placed on output line number 5. Then, in the second of eight time slots, a temperature measurement signal CJT1 is placed on output line number 2, a temperature measurement signal TH9 is placed on output line number 4, and so forth, as shown in FIG. 6. After the eighth of the eight time slots occurs, the cycle repeats, the first of the eight time slots then being executed. In fact, the pattern of sequential placement of measurement signals on the output lines 64 and 76 repeats until a new pattern program is loaded from the memory 86 into the gate array 82.

For example, such a new program is shown in FIG. 7, wherein temperature is not measured at all, and voltage/current measurements are acquired twice as often as in FIG. 6.

To add further economies, the A/D converter in the DAS that is used to read out the image data is at least partly used to read out the AUX data as well, the AUX data words being read out in tandem with image data words provided by the data acquisition system (DAS) of the CT scanner. Consequently, separate system monitoring and diagnostic devices, and their associated probes, cabling, and separate A/D converters are not needed, because at least some of the DAS channels can accommodate the various needed measurement data without additional dedicated A/D converters.

The measurement data needed for proper characterization of the subsystems of the CT scanner includes temperature measurement data, anode motor rotation noise, high voltage power supply voltages, x-ray tube current, and other parameters and conditions. Under normal operating conditions, these measurement data change slowly with respect to the rate of change of the image data. Consequently, they can be processed at one eighth the unmultiplexed rate without significantly sacrificing accuracy.

However, when testing, debugging, or diagnostics must be performed, measurement data can change more rapidly. To ensure timeliness and immediacy of the measurements, the measurement data is read out more frequently than the one eighth rate, e.g., at the same rate that the image data is read, or at one half the rate that the image data is read. Reading the measurement data more frequently allows more accurate and rapid determination of, for example, the nature and extent of a system malfunction.

In particular, an x-ray detector can change characteristics as a function of temperature. This temperature changes slowly, and can be measured with precision by the main A/D converter that is used to read out image data. The readings thereby obtained can be read out on an AUX data channel. In this manner, x-ray detector characteristic drift can be monitored as a function of temperature in a calibration cycle. Then, during normal operation of the CT scanner, the image data can be corrected according to the actual detector temperature observed, and the temperature characteristics compiled during the calibration cycle.

Also, the anode bearing of the rotating anode x-ray tube wears out over its life. An indication of bearing wear is the amount of acoustic noise emitted by the bearing as it operates. A small accelerometer can detect this acoustic bearing noise. Thus, the health of the x-ray tube can be ascertained by monitoring a signal from the accelerometer, and an operator of the CT scanner can thereby be warned of impending x-ray tube failure.

To achieve the prompt and immediate detection of certain components of the AUX data, some components of the AUX data are not sampled at all, such as temperature, while others are sampled at the same rate that image data is sampled. FIG. 8 shows another program wherein temperature is not measured at all, and voltages VN1, VN2, and VN3 are sampled at the same rate that the image data is sampled.

Thus, the present invention provides an improvement over the prior art. The system and method avoids the use of a separate monitoring or diagnostic measurement system for each such measurement to be performed, as well as the need for a separate A/D converter and separate cabling to connect each separate measurement system to a main computer. Auxiliary data, such as system monitoring or system diagnostic measurement data, is conveyed via a plurality of data acquisition system (DAS) channels that are primarily dedicated to conveying image data, without sacrificing throughput of the image data. Thus, a CT scanner can be provided that is capable of transmitting auxiliary data through the same DAS used to process image data. The selection and sequence of auxiliary data transmitted is programmable and can be defined for each operating mode, as for example, a system operation monitoring mode and a diagnostic debugging mode.

Other modifications and implementations will occur to those skilled in the art without departing from the spirit and the scope of the invention as claimed. Accordingly, the above description is not intended to limit the invention except as indicated in the following claims.

What is claimed is:

1. A medical imaging system comprising:

means for generating a plurality of image analog signals representative of image data acquired by said system;

means for generating at least one non-image analog signal representative of at least one operating parameter or condition of said system;

analog-to-digital converter means for converting image and non-image analog signals to corresponding image and non-image digital signals; and programmable means, responsive to a program signal, for selectively applying select ones of two or more of said analog signals to said analog-to-digital converter means in either one of at least two predetermined modes of operation as a function of said program signal.

2. A medical imaging system comprising:

analog-to-digital-converter means for generating a plurality of image and non-image digital signals as a function of a plurality of both image and non-image analog signals received by said analog-to-digital-converter means;

data processor means including means for generating a programming signal;

a data acquisition system for providing image and non-image data to the data processor as a function of the plurality of image and non-image digital signals; and programming means for selectively applying select ones of said analog signals to the analog-to-digital-converter means as determined by the operating mode of said programmable means, the operating mode being a function of said programmable signal.

3. A medical imaging system according to claim 2, wherein said programmable means includes multiplexing means, receiving the plurality of said analog signals, for multiplexing the plurality of analog signals in a predetermined sequence as a function of said programmable signal.

4. A medical imaging system according to claim 3, wherein said programmable means comprises a command module for receiving a mode command signal that represents one of a plurality of data sampling and multiplexing modes, and for providing said programmable signal in accordance with the mode represented by the mode command.

5. The apparatus of claim 4, wherein the command module includes:

a programmable gate array for generating the programmable signal as a plurality of select signals; and a memory module, cooperative with the programmable gate array, for programming the programmable gate array in accordance with a received mode command signal.

6. The apparatus of claim 4, wherein said data processor generates said mode command signal.

7. The apparatus of claim 4, wherein the command module also receives a system status signal from the data acquisition system.

8. The apparatus of claim 4, wherein the plurality of data sampling and, multiplexing modes includes:

a first mode wherein the multiplexing means multiplexes select non-image analog signals so as to sample said select non-image analog signals at a first sampling rate and image analog signals so as to sample said image analog signals at a second sampling rate faster than the first sampling rate; and a second mode wherein at least one non-image analog signal is sampled at said second sampling rate.

9. The apparatus of claim 8, wherein the plurality of data sampling and multiplexing modes further includes:

a third mode wherein at least one signal of the non-image analog signals is sampled at a sampling rate greater than the first sampling rate.

10. A CT scanning system comprising:

source means for generating x-rays and detector means for generating a plurality of image analog signals representative of the x-rays received from said source means;

means for generating a plurality of non-image analog signals representative of system operating parameters and conditions;

at least one analog-to-digital-converter for receiving said plurality of both image and non-image analog signals, and for generating a plurality of corresponding image and non-image digital signals as a function of the respective plurality of both image and non-image analog signals;

a data processor;

a data acquisition system for receiving the plurality of image and non-image digital signals, and providing image and non-image data to the data processor; and programmable means for multiplexing a programmed sequence of the plurality of both image and non-image analog signals defining the operating mode of said programmable means and for applying said multiplexed programmed sequence to said at least one analog-to-digital-converter, the operating mode being a function of a programming signal.

11. A medical imaging system according to claim 10, wherein said programmable means includes multiplexing means, receiving the plurality of said analog signals, for multiplexing the plurality of analog signals in a predetermined sequence as a function of said programmable signal.

12. A medical imaging system according to claim 11, wherein said programmable means comprises a command module for receiving a mode command signal that represents one of a plurality of data sampling and multiplexing modes, and for providing said programmable signal in accordance with the mode represented by the mode command.

13. The apparatus of claim 12, wherein the command module includes:

a programmable gate array for generating the programmable signal as a plurality of select signals; and a memory module, cooperative with the programmable gate array, for programming the programmable gate-array in accordance with a received mode command signal.

14. The apparatus of claim 12, wherein said data processor generates said mode command signal.

15. The apparatus of claim 12, wherein the command module also receives a system status signal from the data acquisition system.

16. The apparatus of claim 12, wherein the plurality of data sampling and multiplexing modes includes:

a first mode wherein the multiplexing means multiplexes select non-image analog signals so as to sample said select non-image analog signals at a first sampling rate and image analog signals so as to sample said image analog signals at a second sampling rate faster than the first sampling rate; and a second mode wherein at least one non-image analog signal is sampled at said second sampling rate.

17. The apparatus of claim 16, wherein the plurality of data sampling and multiplexing modes further includes:

a third mode wherein at least one signal of the non-image analog signals is sampled at a sampling rate greater than the first sampling rate.

18. A method of sampling and multiplexing data in a medical imaging system, the method comprising the steps of:

receiving a plurality of both image and non-image analog signals;

selecting the operating mode from at least two selectable modes of operation of the system, wherein each mode corresponds to a predetermined sequence of analog signals;

multiplexing the predetermined sequence of analog signals of the selected mode; and performing analog-to-digital signal conversion upon the predetermined sequence so as to generate digital signals as a function of the sequence.

19. The method of claim 18, wherein the step of selecting the operating mode includes the step of:

using a stored program to generate the plurality of select signals in accordance with the selected mode command for controlling the step of multiplexing.

20. The method of claim 18, wherein in a first selected mode the step of multiplexing includes the step of sampling each image analog signal at a faster rate than the sampling rate of the non-image signal; and in a second selected mode the step of multiplexing includes the step of sampling at least one non-image analog signal at the same sampling rate as the sampling rate of the image analog signals.

* * * * *